US009895016B2

(12) United States Patent
Van Tassell, III

(10) Patent No.: US 9,895,016 B2
(45) Date of Patent: Feb. 20, 2018

(54) CONTAINER HOLDER HAVING INTERCHANGEABLE HOLDER AND INTERCHANGEABLE TOP

(71) Applicant: Ronald E Van Tassell, III, West Palm Beach, FL (US)

(72) Inventor: Ronald E Van Tassell, III, West Palm Beach, FL (US)

( * ) Notice: Subject to any disclaimer, the term of this patent is extended or adjusted under 35 U.S.C. 154(b) by 0 days.

(21) Appl. No.: 14/701,982

(22) Filed: May 1, 2015

(65) Prior Publication Data

US 2016/0316951 A1 Nov. 3, 2016

(51) Int. Cl.

| | |
|---|---|
| ***B65D 5/64*** | (2006.01) |
| ***A47G 29/00*** | (2006.01) |
| ***A47G 23/02*** | (2006.01) |
| ***B65D 25/24*** | (2006.01) |
| ***B65D 43/02*** | (2006.01) |
| ***B65D 81/02*** | (2006.01) |
| ***B65D 25/10*** | (2006.01) |
| *B65D 8/00* | (2006.01) |

(52) U.S. Cl.

CPC ..... *A47G 23/0241* (2013.01); *A47G 23/02* (2013.01); *B65D 25/108* (2013.01); *B65D 25/24* (2013.01); *B65D 43/0204* (2013.01); *B65D 81/022* (2013.01); *B65D 15/08* (2013.01)

(58) Field of Classification Search

CPC ..... B65D 15/06; B65D 15/08; B65D 81/133; B65D 5/503; B65D 88/522; B65D 88/524; B65D 88/526; B65D 88/528; B65D 25/108; B65D 25/24; B65D 43/0204; B65D 81/022; Y02W 30/807; A47G 23/0241; A47G 23/02

USPC ..... 220/6, 666, 7, 611, 617, 486; 229/125.01, 125.17

See application file for complete search history.

(56) References Cited

U.S. PATENT DOCUMENTS

| | | | | | |
|---|---|---|---|---|---|
| 1,858,856 | A * | 5/1932 | Hadley | B65D 25/108 | 206/3 |
| 3,208,620 | A * | 9/1965 | Herdering | B65D 21/0234 | 220/4.24 |
| 3,734,280 | A * | 5/1973 | Amneus | B65D 5/5028 | 206/432 |
| 3,750,871 | A * | 8/1973 | Cook | B65D 81/025 | 206/433 |
| 3,913,774 | A * | 10/1975 | Vajtay | B65D 15/08 | 220/315 |
| 3,972,441 | A * | 8/1976 | Prodel | B65D 1/243 | 206/139 |
| 3,986,659 | A * | 10/1976 | Vajtay | B65D 15/08 | 220/4.01 |

(Continued)

*Primary Examiner* — J. Gregory Pickett
*Assistant Examiner* — Gideon Weinerth
(74) *Attorney, Agent, or Firm* — Clay McGurk; The Law Office of Clay McGurk

(57) ABSTRACT

The present invention provides 0.0a container holder having a base, an interchangeable holder part and an interchangeable top to hold one or more bottles, containers and jugs, including for example a typical one-gallon plastic milk jug, or bottles of liquor, wine, sports, orange juice. The holder and the top are interchangeable so that the container holder can be assembled to accommodate different types of objects. Different types of snap fit connectors can be used for temporary or permanent connection between the top and the holder and between the holder and the base.

2 Claims, 4 Drawing Sheets

(56) References Cited

U.S. PATENT DOCUMENTS 4,071,064 A * 1/1978 Saul ..... B65D 15/22 206/423
4,195,729 A * 4/1980 Macken ..... A47G 1/14 206/216
4,754,883 A * 7/1988 Grzywa ..... A47G 23/06 206/459.5
4,911,300 A * 3/1990 Colonna ..... B65D 71/50 206/427
4,993,623 A * 2/1991 Kelly ..... B65D 15/08 229/110
5,145,060 A * 9/1992 Maye ..... B65D 71/00 206/446
5,265,797 A * 11/1993 Velge ..... B65D 5/4283 229/125.26
5,582,293 A * 12/1996 Kay ..... B65D 5/4204 206/457
5,641,064 A * 6/1997 Goserud ..... B65D 39/16 206/315.1
5,730,352 A * 3/1998 Deekes ..... B65D 59/06 220/786
5,816,437 A * 10/1998 Lin ..... B65D 15/14 220/611
6,276,555 B1 * 8/2001 Edwards ..... A47J 43/24 220/23.86
6,382,108 B1 * 5/2002 Stanek ..... B65D 19/0038 108/55.1
6,401,952 B1 * 6/2002 Ming ..... A45C 7/00 220/297
6,622,867 B2 * 9/2003 Menceles ..... B65D 11/02 206/461
6,817,471 B2 * 11/2004 Harris ..... B65D 25/10 206/349
6,910,582 B2 * 6/2005 Lantz ..... B65D 5/48038 206/438
7,000,775 B2 * 2/2006 Gelardi ..... B65D 15/08 206/485
D527,424 S * 8/2006 Long ..... D19/77
7,249,686 B1 * 7/2007 Aesquivel ..... B65D 81/262 206/501
8,230,997 B1 * 7/2012 McWilliams ..... B65D 5/5038 206/139
8,448,782 B2 * 5/2013 Chin ..... A45C 11/20 206/217
8,695,794 B2 * 4/2014 Scatterday ..... A24F 15/00 206/242
9,150,350 B2 * 10/2015 Stanek ..... B65D 90/24
9,334,082 B2 * 5/2016 D'Anglade ..... B65D 15/08
2004/0010954 A1 * 1/2004 O'Brien ..... A47F 7/024 40/724
2005/0017000 A1 * 1/2005 Vergiels ..... B65D 19/20 220/4.28
2005/0167305 A1 * 8/2005 Park ..... B65D 5/503 206/320
2006/0065655 A1 * 3/2006 Taylor ..... A45C 7/0036 220/6
2008/0230406 A1 * 9/2008 Cuomo ..... B65D 71/0014 206/175
2008/0296310 A1 * 12/2008 Steele, IV ..... B65D 5/503 220/769
2008/0312054 A1 * 12/2008 Boland ..... B42F 15/007 493/102
2011/0108553 A1 * 5/2011 Pantelleria ..... B65D 43/169 220/319
2013/0048534 A1 * 2/2013 Merrell ..... B65D 81/051 206/591
2013/0277263 A1 * 10/2013 Jung ..... B65D 15/00 206/459.5
2014/0008249 A1 * 1/2014 Muller ..... B65D 85/00 206/139
2014/0076889 A1 * 3/2014 Stolzman ..... B31B 1/00 220/1.5
2014/0299489 A1 * 10/2014 Accettola ..... B65D 25/005 206/139
2014/0319018 A1 * 10/2014 Collison ..... B65D 81/127 206/589
2015/0053240 A1 * 2/2015 Woodlock ..... A47J 47/02 134/22.1
2015/0375893 A1 * 12/2015 Korinek ..... B65D 5/503 493/90
2017/0050757 A1 * 2/2017 Gray ..... B65D 5/503

* cited by examiner

CONTAINER HOLDER HAVING INTERCHANGEABLE HOLDER AND INTERCHANGEABLE TOP

FIELD OF THE INVENTION

The present invention relates generally to the field of container holders, and more particularly to a container holder having an interchangeable holder and an interchangeable top for holding objects having different shapes and sizes.

BACKGROUND OF THE INVENTION

When bringing groceries home in a vehicle, unless properly secured, bottles containers and jugs, such as one-gallon plastic milk jugs, wine bottles, liquor bottles, water bottles, sports drink bottles and orange juice containers, may fall over and roll around when the vehicle is moving. When the vehicle turns a corner, these bottles have a tendency to fall over, and if the bottle has a cylindrical or similar shape, it starts to roll around, possibly even breaking, cracking or rupturing, causing the contents of the bottle to spill into the vehicle. The cost of replacing expensive wines or liquors can be high, plus the damage to a vehicle can be a problem for cleaning up broken bottles and spilled contents. Most of these bottles, containers and jugs do not fit into a typical cup holder found in a vehicle. Therefore, what is needed is for a container holder that would hold objects, bottles, containers and jugs in an upright position when being transported vehicle.

SUMMARY OF THE INVENTION

The present invention provides a container holder having a base, an interchangeable holder part and an interchangeable top to hold one or more bottles, containers and jugs, including for example a typical one-gallon plastic milk jug, or bottles of liquor, wine, sports, orange juice.

An object of the present invention is to provide a container holder that holds one or more bottles, containers and jugs in an upright position during movement of a vehicle.

Another object of the present invention is to provide an interchangeable holder that can be changed for accommodating different shapes, sizes and types of bottles, containers and jugs.

Yet another object of the present invention is to provide an interchangeable top part that can accommodate different types of openings for holding different types of bottles, containers and jugs.

The present invention in one embodiment is a container holder comprising, a base having a shape of rectangular prism and having an opening proportionally centered and having a length and a width; a holder having four sides and an opening at a top and a bottom, the holder having an outside length and an outside width being substantially similar to the length and width of the opening in the base, the holder attached to the base in the opening; and a top attached to the holder at the top.

The present invention in another embodiment is a container holder comprising, a base having a top, a bottom, and one or more sides; an interchangeable holder having one or more sides and an opening at a top, the holder attached to the base via one of adhesive, glue and one or more snap fit connectors, the holder attached to the top of the base; and a top attached to the holder at the top.

The present invention in yet another embodiment is a container holder comprising, a base having a top, a bottom, one or more sides; and a holder having one or more sides, an opening at a top, and one or more snap fit connectors, the holder being attached to the base by the one or more snap fit connectors, wherein a width and a length of the base is greater than a width and a length of the holder; wherein the interchangeable holder is capable of holding one of: one or more milk jugs, one or more bottles of wine, one or more bottles of liquor, and a combination thereof.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed and not to limit it.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENT

Figure 1:
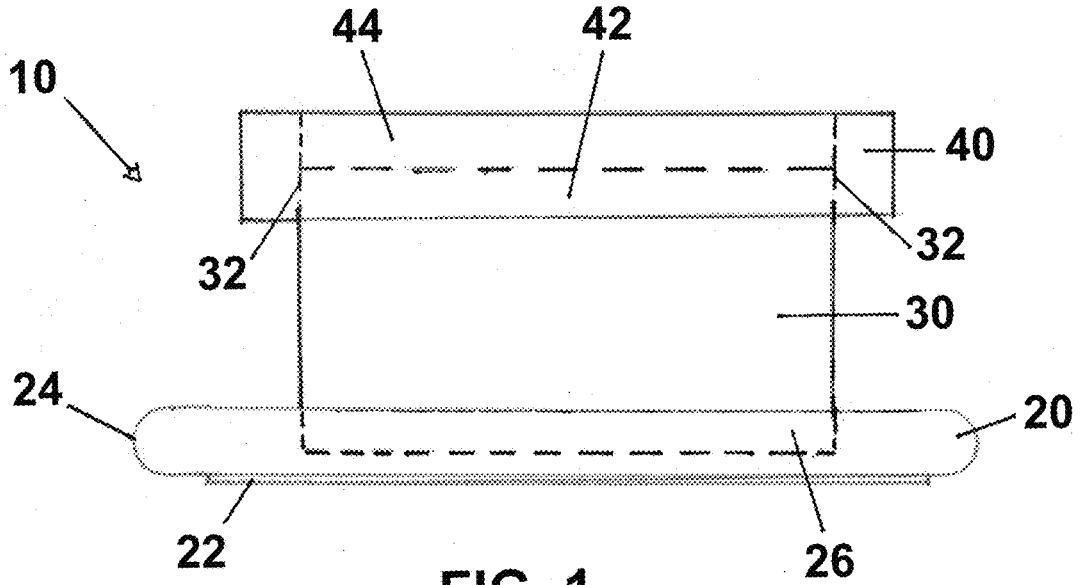
FIG. 1 illustrates a side view of a container holder according to an embodiment of the present invention.

FIG. 1 illustrates a side view of a container holder 10 according to an embodiment of the present invention. Holder 10 comprises a base 20, a holder 30, and a top 40. The base 20, the holder 30 and the top 40 can be each made of wood, plastic, metal or any other material or combination thereof. The container holder 10 illustrated in FIG. 1 is made of wood, where an adhesive (glue or similar) attaches the base 20 to the holder 30. The bottom interior (or inside) portion 42 of the top 40 is made to fit around and against the top, exterior (or outside) edge 32 of holder 30.

Figure 2:
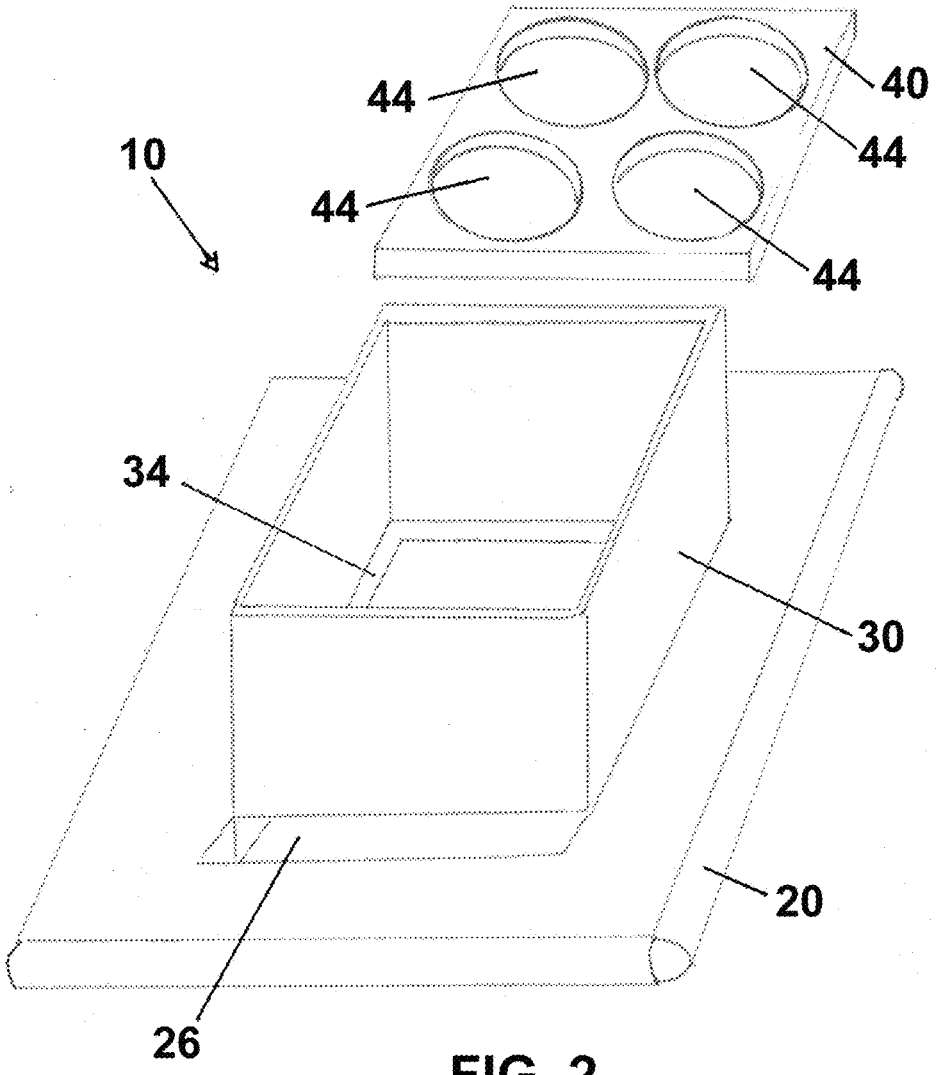
FIG. 2 illustrates a perspective view of a container holder according to an embodiment of the present invention.

The top 40 has an opening at the top and bottom for which all or part of the containers, bottles and jugs can be inserted therein. As illustrated in FIG. 2, the top 40 has four openings or holes 44 for holding four sports or water bottles, or other similar containers, bottles or jugs. In other embodiments, top 44 can have different holes and openings for other types of bottles, containers and jugs. The top 40 as shown in FIGS.

1 and 2 has at least four sides. The bottom interior portion 42 of the top 40 fits over a portion of the top, outside edge 32 of the holder 32, as illustrated in FIG. 1. The dimensions of the top 40 match the outside dimensions of the holder 30 so that the two piece attach or connect to each other via friction. In some embodiments, the top 40 is not needed.

As illustrated in FIGS. 1 and 2, the base 20 is shaped as a rectangular prism having rounded side edges, but can also be other shapes or sizes. In one embodiment, base 20 supports a single holder part 30. In other embodiments, the base 20 supports multiple holders 30 for holding different types of objects, such as a standard one-gallon milk jug in one holder 40 and four bottles of water in other holder 40. Base 20 has to be sturdy and durable for supporting the one or more objects (e.g., bottles, containers and jugs) that are inserted into the container holder 10.

In some embodiments, a thin layer of slide resistant material 22, such as for example, Velcro, rubber or tape, can be attached via an adhesive (e.g., glue) to all or part of the bottom of base 20. The slide resistant material 22 can be in strips (e.g., three strips being parallel to each other) or one large piece that is centrally located. The slide resistant material 22 would give extra traction to prevent the container holder 10 from sliding around in a moving vehicle. In some embodiments, a strip of shock-absorbing material, such as for example rubber or foam, can be attached to the sides 24 of base 20 to provide protection so that base 20 does not damage other objects in the vehicle, and so that other objects or the vehicle do not damage the base 20.

As illustrated in FIGS. 1 and 2, the top of base 20 has a recessed hole or an opening 26. The width and the length of the opening 26 is made to match the outside length and outside width of the holder 30, thereby allowing the bottom part of the holder 30 to fit into the opening 26 in the base 20. The opening 26 is centrally located in the base 20, so that the edges provide proper distribution of weight for an object being held in the base 20. The bottom of the object being held in container holder 10 will rest in the opening 26. In other embodiments, there are multiple openings in the base 20 for attaching different holders 30. Moreover, the opening 26 could have both a rectangular and overlapping circular opening, thereby allowing either a rectangular prism or a cylinder to be inserted therein. In other embodiments, the base 20 does not have an opening 26, so that the holder 30 rests on the top of the base 20. Some or all of the embodiments can be held in place via snap fit connections which are explained below.

The holder 30 comprises a rectangular prism having four sides and an opening at the top and bottom of the holder 30. Holder 30 is illustrated in FIGS. 1 and 2 as having four sides, but other shapes and sizes can be used, such as a cylindrical shape or cubed shape. In some embodiments, the holder 30 may also have a bottom, so that an object when inserted into the holder 30 would rest on the bottom piece. The holder 30 can be molded into one piece of plastic, wood or other material, or the sides and/or bottom bonded with those techniques known to those skilled in the art. The sides of the holder 30 are of sufficient length, width and height to hold one or more particular object in place. For example, if the container holder 10 is to hold a standard one-gallon milk jug, the sides will have sufficient length, width and height to provide proper support to hold the milk jug and prevent it from tipping over. In another example, where the container holder 10 would hold a vodka bottle or a scotch bottle, the sides of the cylindrical holder would be of sufficient circumference, height and width to hold such bottles in place during transport.

If the holder 30 does not have a bottom, in some embodiments, the holder 30 could have an optional ledge or shelf 34 that extends in a perpendicular direction from the bottom of the sides in the interior portion of holder 30 as illustrated in FIG. 2. The ledge 34 can be bonded as one piece of plastic or other material with the holder 30, or alternatively, the ledge 34 can be attached via adhesives, other commercially available bonding agents or L-shaped connectors or hinges and screws. The ledge 34 provides additional strength and stability to the holder 30, so that the container holder 10 will provide proper support and stability to an object being held therein. The ledge 34 also provides an area for bonding, connecting and securely fastening the holder 30 into the base 20 especially when adhesives, glue or screws are used. In other embodiments, the ledge 34 may be triangle portions attached to the corners of where two sides of the holder 30 connect.

Adhesives, screws/nuts, clips, snap-fit connectors and any other connector or attachments can be used to join, bond, or connect the base 20 to the holder 30. In some embodiments, the base 20 and the holder 30 can be molded into one piece of plastic or other type of material.

Snap-fit connectors can be used for joining or connecting the holder 30 to the base 20, and the top 40 to the holder 30. Snap fits are commonly used as an assembly method for injection molded parts. Snap fits are useful because they eliminate screws, clips, adhesives or other joining methods. The snaps are molded directly into the holder 30, so additional parts are not needed to join them together. Additionally, some snap fits can be dissembled and reassembled several times without any problems. A snap fit can either be designed as a permanent snap or a multiple snap. Permanent snap fits are used in disposable parts that are never meant to be disassembled. Multiple snaps are used in most designs where disassembly is expected.

Figure 3A:
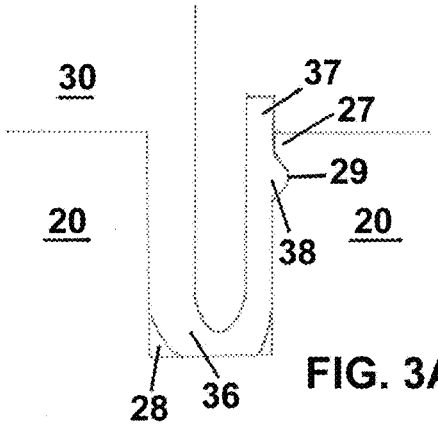
FIGS. 3A and 3B illustrate different snap fit connections between the holder and the base according to different embodiments of the present invention.
Figure 3B:
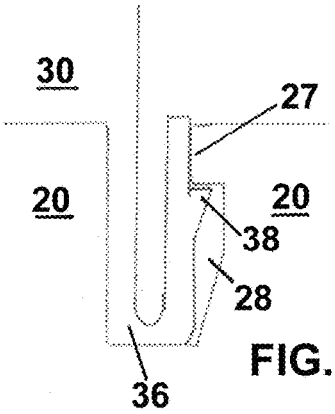

FIGS. 3A and 3B illustrate different snap fit connections between the holder 30 and the base 20 according to different embodiments of the present invention. The U-shaped snap connector arm 36 in both FIGS. 3A and 3B is located on, molded into or attached to the bottom of the holder 30. The connector arm 36 fits into or slides into the hole or opening 28 in base 20. FIG. 3A illustrates a U-shaped snap fit arm 36 that uses an angled surface for both the assembly and disassembly portions of the cantilever arm 36 and the recess 29. The snap fit arm 36 can be removed with the same force used in assembly. To assemble, the arm 36 is pushed into the hole 28 in base 20, whereby the snap fit protrusion 38 on arm 36 will slide over the lip 27 and into the recess 29. The bottom of the base 30 touches the top of base 20, and the snap fit arm 29 touches parts of the hole 28 as illustrated in FIG. 3A. To release and disassemble the holder 30 from the base 20, the top part 37 of arm 36 is pushed, thereby the force on the arm 36 releases the snap fit protrusion 38 from the recess 29 in base 20, and then the base 20 can be pulled upward to release the snap fit connector arm 36 from the hole 28 in the base 20.

FIG. 3B shows a snap fit connector arm with a 90° hook and a 90° recess. This type of snap fit connection is used where a permanent connection is desired and where disassembly is not needed. As illustrated in FIG. 3B, a U-shaped snap-fitting arm 36 is located on, molded into or attached to the bottom of the holder 30. The snap-fitting arm 36 fits into a snap-fit opening or hole 28 in the base 20, whereby the snap fit protrusion 38 slides over the lip or extension 27 at the top of the opening 28, and then engages the bottom of the lip 27 with the snap fit protrusion 38 as illustrated in FIG.

3B. The bottom of the holder 28 rests on top of the base 20, and the snap fit arm 36 rests on portion of the inside of the opening 28.

There are many types of snap fit connectors that can be used other than those illustrated in FIGS. 3A and 3B for joining the holder 30 to the base 20. Also, the location and the number of snap fit connectors 36 on a holder 30 can be varied. In one example, a snap fit connector may be located on the center point along the bottom of the edge of each of the sides of the holder 30. This configuration allows the holes 28 in the base 20 to be used for holders 30 having different shapes (e.g., rectangular prism, a cube and cylinder), but sharing the same location of the snap fit arms in relation to the base 20. In another example, two snap fit connectors would be located on one side of the holder 30, and two other snap fit connectors would be located on the opposite side. In another example, eight snap fit connection would be located on a rectangular prism where two snap fit connectors would be on each side, one snap fit connector close to the each of the end of the sides.

Figure 4A:
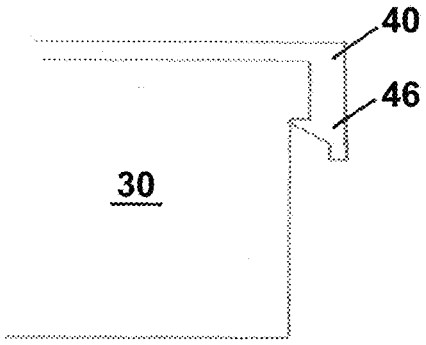
FIGS. 4A and 4B illustrate a top having snap fit connectors according to an embodiment of the present invention.
Figure 4B:
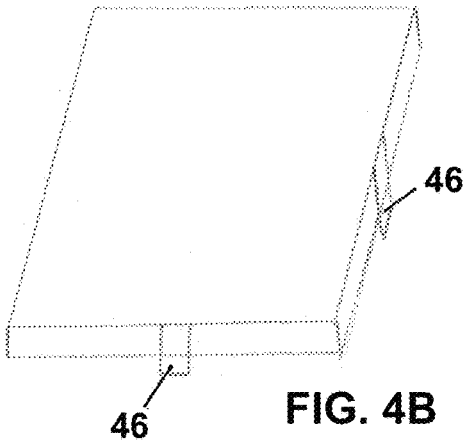

FIGS. 4A and 4B illustrate the top 40 having snap fit connectors 46 according to an embodiment of the present invention. As illustrated in FIG. 4A, the protrusion of the snap fit connector 46 slides over an extending lip around the top of the holder 40, whereby the snap fit protrusion makes contact with the bottom of the extending lip. The snap fit connector arm of the top 40 has a 90° hook, and the holder 30 has a 90° recess. The top 40 is held in place on the holder 30, but can be disassembled by pulling the top of the arm 46 so the protrusion disengages from the extending lip. A snap fit connector 46 can be located in the center point, region or area on each side of the top 40 as illustrated in FIG. 4B, although other locations can be used as well.

Figure 5:
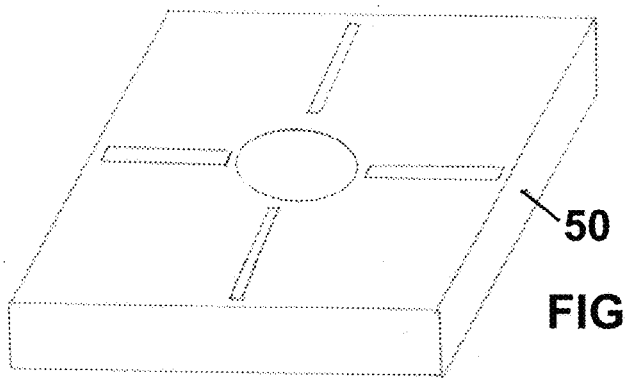
FIG. 5 illustrates a grate according to an embodiment of the present invention.

FIG. 5 illustrates a grate 50 according to an embodiment of the present invention. The grate 30 is shaped to match the shape of the holder 30, and has dimensions to fit inside the holder 30. The grate has various holes of different shapes and sizes on the top as illustrated in FIG. 5. The grate 30 fits through the opening of the holder 30, and rests along the inside edge of the bottom of the holder 30. Depending on the configuration, grate 30 may rest on the top of the base 20, on the top of the opening 26 in the base 20, or on the bottom ledge 34 of the holder 30. In one embodiment, the sides of grate 50 have enough height so that a cooling agent (such as frozen gel pac or something similar) can rest underneath the grate 50 to provide a way to keep the objects resting on the grate cool. In other embodiment, the sides of grate 50 such that condensation that drips from object stored in the container holder 10 would drip through the openings on grate 50 and onto a sponge-like material to absorb such condensation. The grate 50 can be made of any material, including for example, wood, stone, plastic, metal, etc.

Figure 6A:
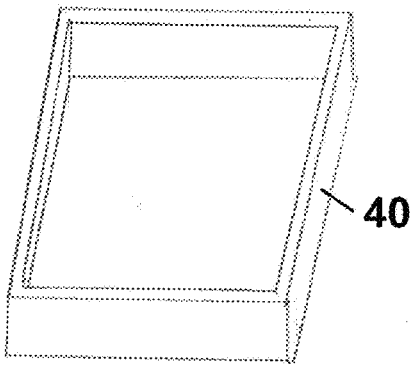
FIGS. 6A and 6B illustrate an interchangeable top having different openings according to different embodiments of the present invention.
Figure 6B:
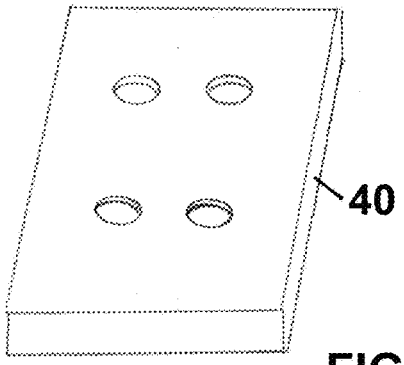

In some embodiments, the holder 30 and the top 40 are interchangeable parts of the container holder 10. This interchangeable configuration allows the container holder 10 to be assembled to hold certain objects, then disassembled and assembled for different objects. The interchangeable top 40 can have four openings 44 for holding water bottles or sports bottles as illustrated in FIG. 2. Alternatively, the interchangeable top 40 can have a single opening as illustrated in FIG. 6A for holding a milk jug for example. Further, the interchangeable top 40 can have smaller openings as illustrated in FIG. 6B for holding the necks of wine bottles or other liquor bottles for example. These types of interchangeable tops 40 can be held via friction where the inside portion of a particular top would make contact with the outside top of the holder 30, or via a snap lock connection (or otherwise) as illustrated in FIG. 4A. In some embodiments, the top 40 and the holder 30 are formed or molded into one piece, where the top of the holder has a particular shape to hold an object in place.

Figure 7A:
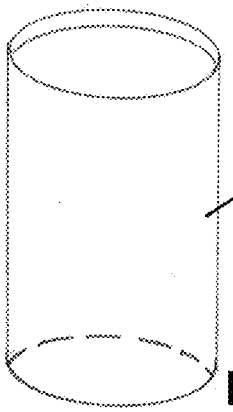
FIGS. 7A and 7B illustrate an interchangeable holder having different openings according to different embodiments of the present invention.
Figure 7B:
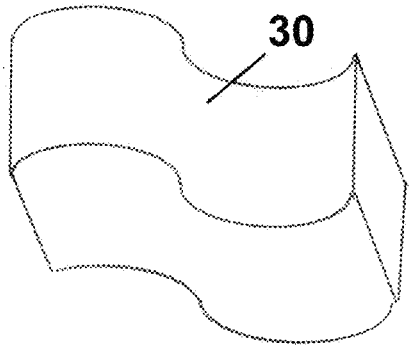

Similarly, the holder 30 can be interchangeable with different shapes and sizes. The holder 30 illustrated in FIG. 2 can be shaped as a rectangular prism that fits into an opening in the base 20 or rests on top of the base 20. As illustrated in FIG. 7A, the interchangeable holder 20 could be shaped as a cylinder, for holding larger bottles of liquor, such as scotch, vodka or wine. The shape of the holder 30 as illustrated in FIG. 7B is for holding two one-gallon milk jugs in a configuration to help balance them and offset any tendency to fall over during transport in a moving vehicle.

It should be apparent to one skilled in the art that the container holder 10 of the present invention can hold a variety of different objects depending on the shape and size of the base 20, the holder 30 and the top 40. One configuration of the container holder 10 can hold a one-gallon milk jug, or four bottles or wine, or four bottles or water or sports drink, or any other type of bottle, container or jug. While the invention has been described in detail and with reference to specific embodiments thereof, it will be apparent to those skilled in the art that various changes and modifications can be made therein without departing from the spirit and scope thereof. Thus, it is intended that the present invention cover the modifications and variations of this invention provided they come within the scope of the appended claims and their equivalents.

What is claimed is:

1. A container holder comprising:

a holder having one or more sides, and an opening at a top and a bottom;

a top having an opening at a top and a bottom, an interior portion of the bottom of the top capable of being attached over the one or more sides of the top of the holder; and a solid base having a top, a bottom, and one or more sides, the solid base attached in a proportionally central location to the holder via adhesive or one or more snap fit connectors, wherein a length and a width of the solid base equally protrude a distance in the horizontal direction from the one or more sides of the holder, the distance being a minimum of five times the width of an over-hanging part of the top when the top is attached to the one or more sides of the top of the holder.

2. The container holder of claim 1, wherein the top has multiple openings at the top.

* * * * *